US005867837A

United States Patent [19]

Otto et al.

[11] Patent Number: 5,867,837

[45] Date of Patent: Feb. 9, 1999

[54] FLEECE SOCK

[75] Inventors: Ricky David Otto, Ventura; OkSu Sin Jackson, Goleta, both of Calif.

[73] Assignee: Deckers Outdoor Corporation, Goleta, Calif.

[21] Appl. No.: 1,252

[22] Filed: Dec. 30, 1997

[51] Int. Cl.[6] ..... A41B 11/00

[52] U.S. Cl. ..... 2/239; 2/409

[58] Field of Search ..... 2/239, 409; 66/178 R, 66/189, 191, 194; 36/1, 10, 8.3, 9 R

[56] References Cited

U.S. PATENT DOCUMENTS

| | | | |
|---|---|---|---|
| 365,671 | 6/1887 | Chester | 2/239 |
| 1,162,820 | 12/1915 | Taylor | 2/239 |
| 1,434,941 | 11/1922 | Boyd | 2/239 |
| 1,731,696 | 10/1929 | Zinky . | |
| 1,968,995 | 8/1934 | Decker et al. | 2/409 |
| 2,636,287 | 4/1953 | Heilbronner | 2/239 |
| 3,120,051 | 2/1964 | Spurgeon . | |
| 3,126,134 | 3/1964 | McAnally . | |
| 3,738,294 | 6/1973 | Christiansen . | |
| 3,874,001 | 4/1975 | Patience et al. . | |
| 4,133,276 | 1/1979 | Selvi . | |
| 4,133,277 | 1/1979 | Arthur et al. . | |
| 4,292,180 | 9/1981 | Zylka et al. . | |
| 4,809,447 | 3/1989 | Pacanowsky et al. . | |
| 4,845,862 | 7/1989 | Phillips, Jr. et al. . | |
| 5,020,164 | 6/1991 | Edwards . | |
| 5,038,414 | 8/1991 | Freeman . | |
| 5,450,630 | 9/1995 | Hale . | |
| 5,466,526 | 11/1995 | Magata . | |

FOREIGN PATENT DOCUMENTS

| | | | |
|---|---|---|---|
| 867543 | 11/1941 | France | 2/239 |

*Primary Examiner*—Gloria M. Hale
*Attorney, Agent, or Firm*—Juettner Pyle Piontek & Underwood

[57] ABSTRACT

A fleece sock is made from a first blank of fleece material of a length and width to cover the foot and to encompass at least part of the ankle of a wearer, the blank having an arcuate cut-out in each side thereof in the region to be occupied by the heel of the wearer and being folded in half to align the cutouts, and a second, generally circular blank of fleece material formed into a separate heel cup having arcuate marginal edges. The marginal edges of the heel cup are aligned with and secured to the marginal edges of the arcuate cut-outs in the first blank, and the remaining marginal edges of the first blank are secured to one another to form a seam that extends along one side of the foot and ankle of the wearer. The two blanks as thus secured together form a sock with seamless plantar and dorsal surfaces, a seamless side surface, a fitted heel cup and at least a partial ankle encompassing portion. The heel cup mitigates creeping of the sock down over the heel of the wearer and balling of the sock under the wearer's foot. The sock fits comformably to the wearer's foot and has large seamless areas and minimal stitching to insure wearer comfort.

20 Claims, 4 Drawing Sheets

FLEECE SOCK

FIELD OF THE INVENTION

The present invention relates to socks or stockings made from a spun fleece material and particularly intended to be worn for outdoor camping and sporting activities.

BACKGROUND

Spun fleece, also known as polar fleece, is a lightweight, breathable, cushioning and quick drying material which when worn imparts warmth and comfort to the human body. It is especially useful for manufacture of socks intended to be worn during activities such as outdoor camping, hiking, boating, skiing and the like where cold and/or wet conditions are likely to be encountered.

U.S. Pat. No. 5,450,630, issued Sep. 19, 1995 to Don Hale, discloses a fleece sock and method of manufacture, and describes with particularity the advantages of fleece over other materials customarily employed for manufacture of socks for outdoor activities. The disclosure of the Hale patent is incorporated herein by reference. However, there are some disadvantages inherent in the fleece socks heretofore available, most notably; (1) a tendency of the sock to creep or slip down under the heel of the wearer's foot, to ball up under the foot, and eventually to cause the ankle and calf portions of the sock to creep into the wearer's shoe, leaving the wearer's calf and ankle exposed to the elements and causing the wearer great discomfort; (2) a tendency of the sock to bunch up over the wearer's instep, resulting in a poor fit of the sock on the foot and causing the wearer further discomfort; and (3) the extensive stitching required to form the sock, thereby creating seams that are confined between the wearer's foot and shoe at anatomically sensitive locations causing rubbing, chaffing and even blistering of the wearer's foot.

SUMMARY OF THE INVENTION

The object of the invention is to provide improved fleece socks and methods of making fleece socks that overcome the disadvantages above described.

A particular object of the invention is to provide a fleece sock having a separately formed heel cup that is so associated with the foot and ankle encompassing portions of the sock as to eliminate or at least greatly alleviate the problem of the sock creeping down under the heel and into the wearer's shoe.

Another object of the invention is to provide a fleece sock designed and constructed in such manner as to mitigate bunching of the sock over the wearer's instep.

A further object is to provide a fleece sock so designed and constructed as to have minimal stitched seams, and to have the seams located outside or away from anatomically sensitive areas, thereby to eliminate the prior art problem of rubbing, chaffing and blistering.

Yet another object of the invention is to provide a fleece sock that is easy and economical to make and that provides an excellent fit on the wearer's foot.

A still further object is to provide a method of making the improved fleece sock of the invention in a facile, practical and highly economical manner.

Pursuant to the invention, an improved fleece sock is comprised of a first blank of flat fleece material to be conformed to the foot, ankle and calf of the wearer and a second blank of flat fleece material to be conformed to the heel of the wearer's foot. The first blank has one end to be occupied by the toes of the wearer and an opposite end to be occupied by the ankle and calf of the wearer. The toe end of the blank has a center line and a rounded toe section on each side of the center line. An arcuate cut-out is provided on each side of the first blank in the region of the sock to be occupied by the wearer's heel. The first blank is folded along the center line of the toe end to align the two toe sections, the two cut-outs and the side edges of the blank between the toe sections and the cut-outs. The margins of the toe sections and these side edges are secured together.

The second blank is generally circular or elliptical and has two opposed v-shaped dart cuts therein. The marginal edges of each of the dart cuts are secured together to form the second blank into a heel cup having arcuate marginal edges. The arcuate edges of the heel cup are secured to the marginal edges of the arcuate cut-outs in the first blank.

The shapes of the two blanks and the manner in which they are secured to one another results in the formation of a sock having, seamless, unobstructed, plantar and dorsal surfaces, a seam along just one side of the foot, preferably the outer or lateral side of the foot, a separate heel cup fitted to the wearer's foot and preventing creeping and balling of the sock under the heel and foot, and an ankle and calf encompassing portion. By virtue of the design of the blanks, the seam joining the marginal edges of the ankle and calf encompassing portions is located at the rear or anterior surface of the leg.

Additionally, a cut-out and cut-out closing seam may be provided in the region of the first blank to be occupied by the instep of the wearer's foot thereby to fit the sock to the wearer's instep and prevent bunching of the sock in this area. The instep seam is preferably stretchable to conform the sock to the instep. The rest of the seams are preferably flatlock seams so that there are no ridges on the sock to dig into the wearer's skin and cause discomfort.

The resultant sock is very comfortable to wear and fulfills all of the objects stated above.

These and other objects and advantages of the invention will become apparent from the following detailed description as considered in conjunction with the accompanying drawings.

DETAILED DESCRIPTION OF PREFERRED EMBODIMENTS OF THE INVENTION

The following is a detailed description of preferred embodiments of the invention which are presently deemed by the inventors to be the best mode of carrying out the invention. Changes, variations and adaptations of the same will become apparent to those of reasonable skill in the art as the description proceeds.

Figure 1:
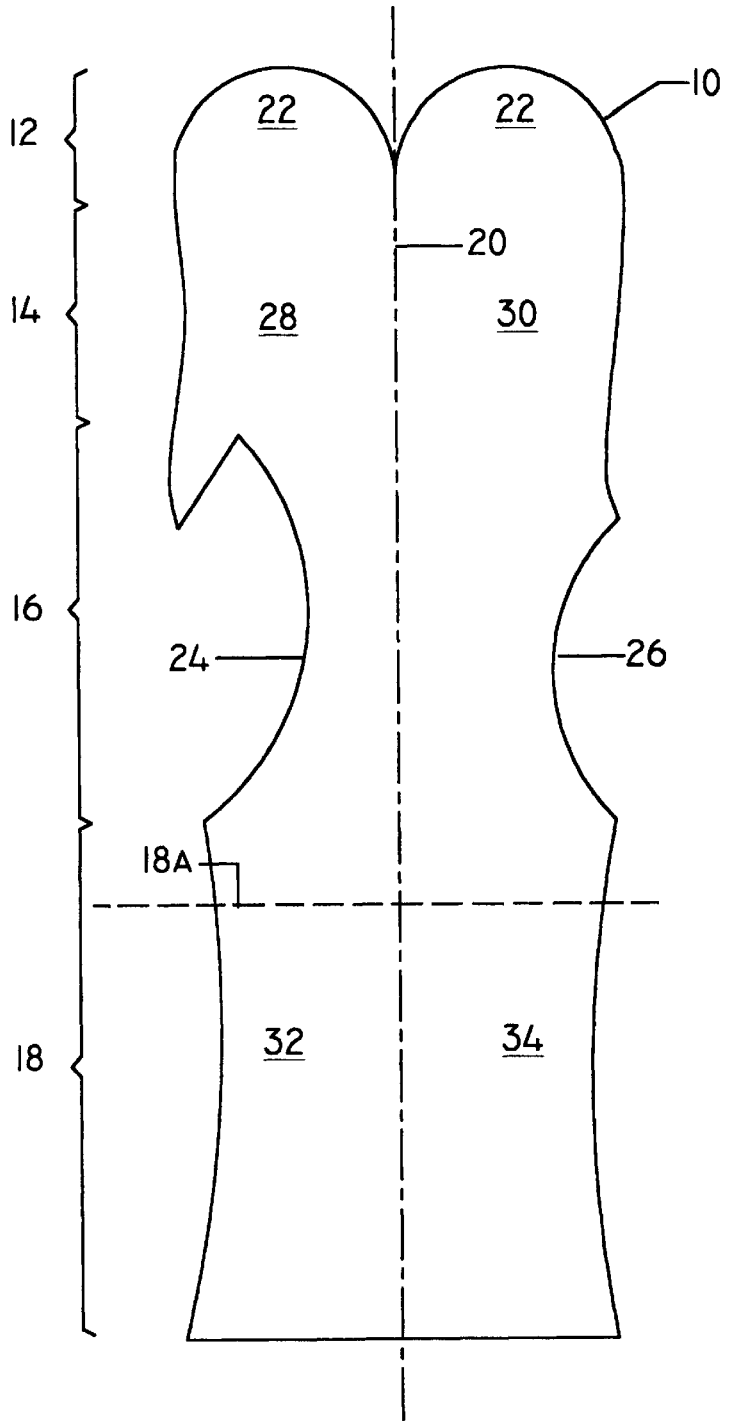
FIG. 1 is a plan view of a sock blank cut from a flat piece of spun fleece and designed to form the foot, ankle and calf portions of the sock of the invention.
Figure 2:
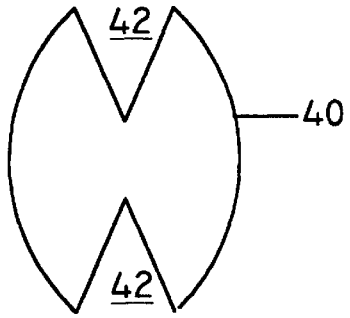
FIG. 2 is a plan view of a heel blank cut from a flat piece of spun fleece and designed to form the heel cup of the sock of the invention.

Referring to FIGS. 1 and 2, the fleece sock of the invention in its preferred embodiment is comprised of a foot, ankle and calf pattern or blank 10, hereinafter referred to as sock blank 10, and a heel pattern or blank 40, both cut or formed from flat pieces of spun fleece material. The fleece material preferably comprises 100% spun polyester fabric, such as described in Hale U.S. Pat. No. 5,450,630. The fabric preferably has at least two-way stretch, and may if desired have four-way stretch. Also if desired, the fabric may be comprised in major part of recycled polyester plastics.

The sock blank 10 (FIG. 1) is comprised of a toe region 12, i.e., a region to be occupied by the toes of the wearer, a region 14 to be occupied by the ball and arch of the wearer's foot, a heel region 16 and an ankle and calf encompassing region 18. The region 18 is of variable length to cover all or only part of the wearer's calf, or even to be foreshortened to ankle length (as indicated by the dotted line 18*a*) or the short anklet length currently favored by golfers. The region 18*a* should in any event encompass at least part of the wearer's ankle.

The toe region 12 of the blank 10 has a longitudinal center line 20 and a curved or rounded toe section 22 on each side of the line. Within the heel region 16, the blank is cut or formed to define arcuate cut-outs 24 and 26 on each of its two sides. One of the cut-outs, namely, the cut-out 24 which is intended to be located on the outer or lateral side of the wearer's foot, is in the form generally of about three-fourths of an ellipse to facilitate and augment the fit of the finished sock to the wearer's heel.

The toe, ball and arch regions 12 and 14 of the blank 10 are generally symmetrical relative to the centerline 20 and define panels 28 and 30 to opposite sides of the line. When the blank is folded in half along the line and the marginal edges of the toe sections 22 and panels 28 and 30 are stitched together, as will be described, the stitched seam will extend along one side (the lateral side) of the foot and the panels 28 and 30 will comprise smooth and unobstructed (seamless) plantar and dorsal surfaces of the sock, respectively.

The heel and ankle regions 16 and 18 of the blank are asymmetrical relative to the centerline 20 of the toe region 12, having less material in a side panel 32 adjacent cut-out 24 and more material in a side panel 34 adjacent cut-out 26. As a consequence, when the blanks are stitched together, in the manner to be described, the seam joining the marginal edges of panels 32 and 34 will be located at the back or anterior surface of the ankle and calf of the wearer.

The heel blank 40 is butterfly shaped, having side edges with generally circular or elliptical curvature corresponding to that of the cut-out 26 and the base part of the cut-out 24 in the blank 10. The blank 40 is formed with two V-shaped dart cut-outs 42 that are opposed to one another and so shaped that when the marginal edges of each V-cut are secured together the blank is transformed into a cup shape. The cup thus formed receives the wearer's heel.

Figure 3A:
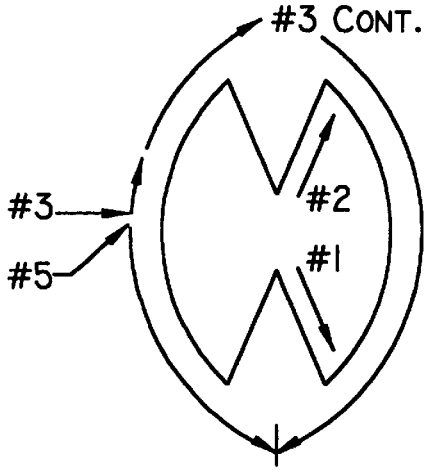
FIGS. 3*a* and 3*b* are diagrammatic illustrations of the manner and sequence in which the foot blank of FIG. 1 and the heel blank of FIG. 2 are stitched together to form the sock of the invention.
Figure 3B:
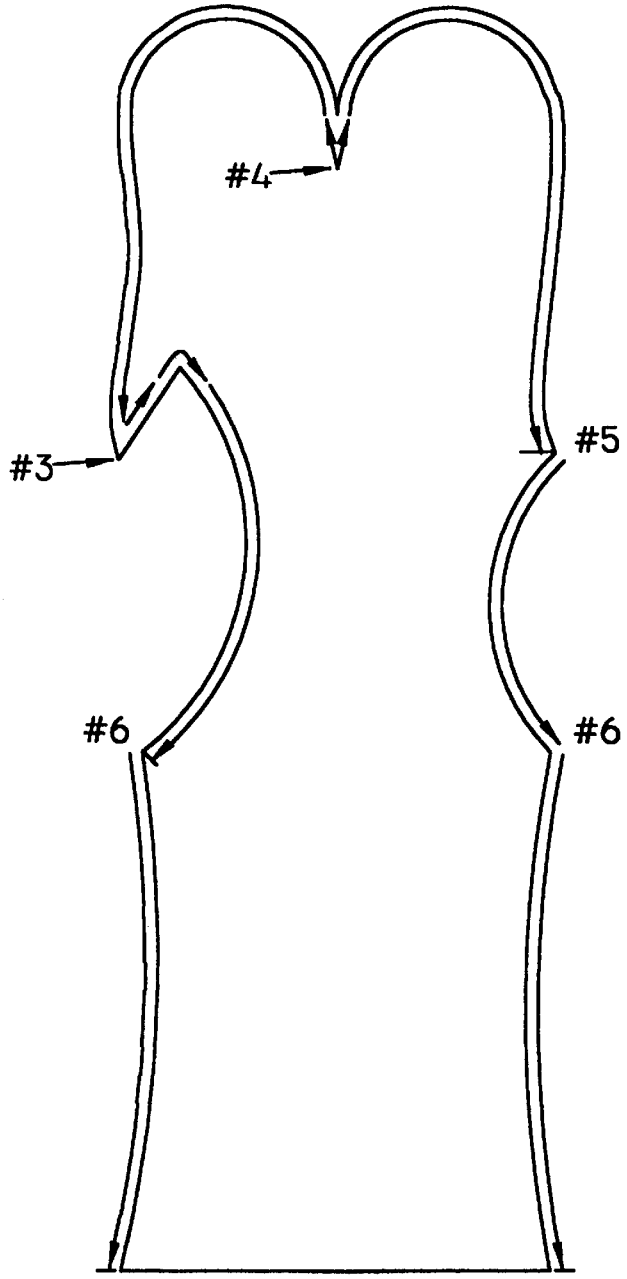
Figure 4:
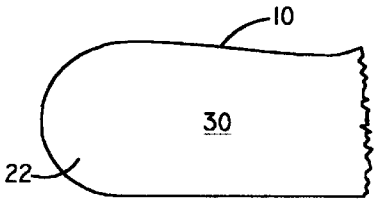
FIG. 4 is a fragmentary top plan view of the upper or dorsal surface of the preferred embodiment of the sock.
Figure 7:
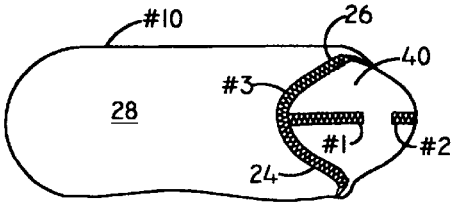
FIG. 7 is a plan view of the sole or plantar surface of the preferred embodiment of the sock.
Figure 5:
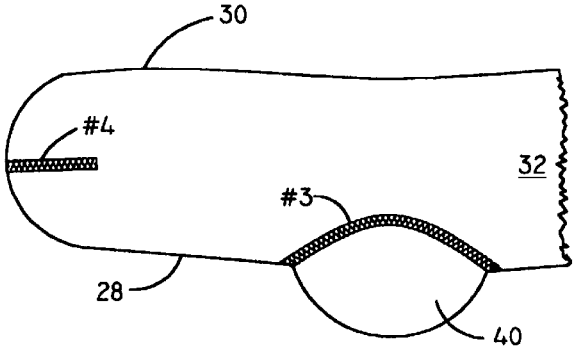
FIG. 5 is a fragmentary elevational view of one side of the sock, which in the preferred embodiment of the invention is positioned on the inner or medial side of the foot.
Figure 8:
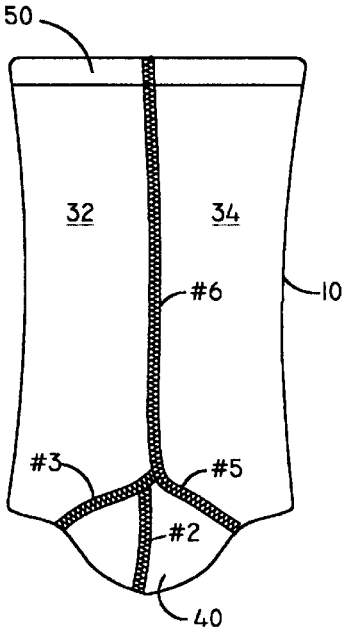
FIG. 8 is a rear elevation of the preferred embodiment of the sock.
Figure 6:
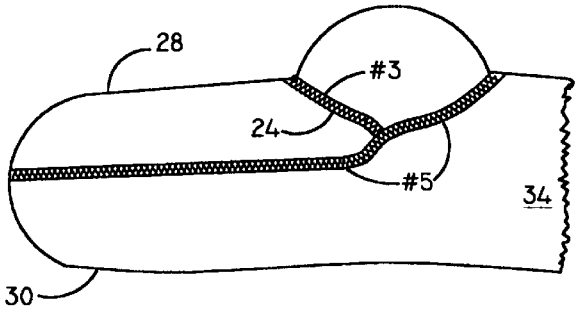
FIG. 6 is a fragmentary elevational view of the other side of the sock, which in the preferred embodiment of the invention is positioned on the outer or lateral side of the foot.

The sequence of sewing the two blanks to form a finished sock is illustrated schematically in FIGS. 3A and 3B. As shown by the arrows #1 and #2, the marginal edges of each of the V-shaped dart cut-outs in the blank 40 are stitched together to form a heel cup having an arcuate marginal edge. About three-fourths of the marginal edge of the cup is then stitched to the marginal edge of the partially elliptical cut-out 24 in the blank 10, as indicated by the arrows #3. The blank 10 is then folded along the centerline 20 to align the edges of the two sections 22 and the panels 28 and 30 and these edges are then stitched together as indicated by the arrows #4. The remaining portion of the marginal edge of the heel cup 40 is then stitched to the marginal edge of the arcuate cut-out 26 in the blank 10, as indicated by the arrows #5. Finally, the marginal edges of the ankle and calf panels 32 and 34 are stitched together as indicated by arrows #6. To complete the sock, it is preferable to fold over the top margin of the calf panels 32 and 34 and stitch the same together to form a collar 50 and a finished edge at the top of the sock, as illustrated in FIG. 8. The collar 50 is preferably stitched using a stretchable top and bottom cover stitch to impart calf gripping elasticity to the collar.

In the preferred embodiment of the sock, the stitches indicated by the arrows #1–#6 are flatlock stitches joining abutting edges of the fleece fabric so there are no ridges in the finished sock. Also in the preferred embodiment, the stitches indicated by the arrows #4, #5, and #6 comprise one continuous stitched seam performed in a single operation on a flatlock stitching machine. Further, there are no overlapping stitches and thus no bulky multiple stitched points or areas in the sock. In particular, stitch #4, #5, #6 bypasses and does not overlap stitch #3. Consequently, the wearer will not be subject to the irritation and chaffing that can be caused by ridged or ribbed stitching.

Folding the blank 10 in one direction about the centerline 20 will result in formation of a left foot sock and folding in the opposite direction will result in a right foot sock. Alternatively, two socks can be made in the same direction and one of them turned inside out to make a pair.

Manufacture of the socks is therefore very straightforward and economical.

The completed sock is illustrated in FIGS. 4–8. As will be observed, the dorsal (FIG. 4), plantar (FIG. 7) and medial side (FIG. 5) surfaces of the sock are substantially smooth, seamless and unobstructed, to afford optimum comfort to the wearer. The heel cup 40, as shown in FIGS. 5–8, has a smooth contour conformably fitting the wearer's heel and effective to mitigate creeping of the sock downwardly under the wearer's heel and balling-up of the sock under the heel and foot. The present invention thus overcomes significant disadvantages encountered in use of prior art fleece socks.

Another disadvantage encountered in use of some fleece materials and with some fleece sock designs is a tendency of the fleece to bunch up over the area where the ankle merges into the dorsal surface of the foot, specifically over the instep of the foot. Should this problem occur, the modified designs shown in FIGS. 9 and 10 may be employed to cure the problem.

Figure 9:
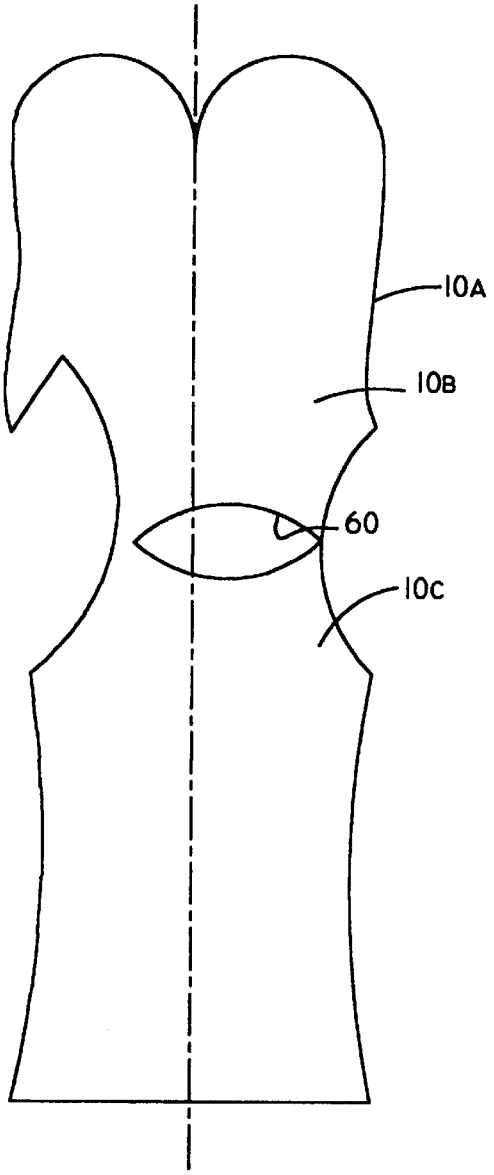
FIG. 9 is a plan view of a second embodiment of sock blank provided in accordance the invention and especially designed to eliminate bunching over the instep of the wearer and to accommodate different instep heights so the sock will fit comformably to a variety of feet.

In the embodiment of FIG. 9, a sock blank 10*a*, which is essentially the same as previously described blank 10, is provided with a transverse elliptical cut-out 60 in the region of the sock that will overlie the instep of the wearer's foot, thereby defining a lower foot portion 10*b* and an upper ankle portion 10*c*. By securing the marginal edges of the cut-out 60 to one another, the sock will be more closely contoured to the ankle/foot instep region and the problem of bunching will thereby be overcome.

Figure 10:
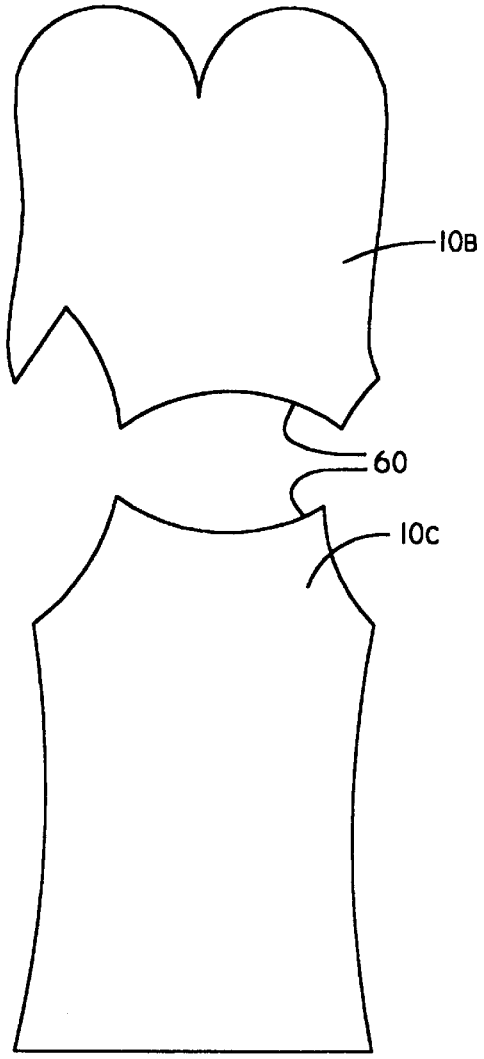
FIG. 10 is a plan view of a two piece sock blank comprising a third embodiment of the invention which serves the same purposes and provides the same advantages as the blank of FIG. 9.

In the embodiment of FIG. 10, the same result is attained by making a sock blank from two pieces or portions 10*b* and 10*c* having juxtaposed ends, forming a semi-elliptical cut-outs 62—62 in each of the ends, and securing the marginal edges of the cut-outs to one another.

In both FIG. 9 and FIG. 10, the marginal edges of the cut-outs 60, 62—62 are secured together using a top and bottom cover stitch which allows the finished seam to stretch up to 200% and thereby adapt the sock to insteps of different heights and to cause the sock to fit conformably to the instep of the wearer.

The objects and advantages of the invention have therefore been shown to be attained in a convenient, practical, economical and facile manner.

While certain preferred embodiments of the invention have been herein illustrated and described, it is to be appreciated that various changes, rearrangements and modifications may be made therein without departing from the scope of the invention as defined by the appended claims.

What is claimed is:

1. A fleece sock comprising a first blank of fleece material of a length and width to cover the foot and to encompass at least part of the ankle of a wearer, said blank having an arcuate cut-out in each side thereof in the region to be occupied by the heel of the wearer, said blank being folded, and a second, generally circular blank of fleece material having opposed V-shaped dart cut-outs therein, the marginal edges of each dart cut-out being secured together and forming said second blank into a heel cup having arcuate marginal edges, the arcuate marginal edges of said heel cup being aligned with and secured to the marginal edges of the arcuate cut-outs in said first blank, the marginal edges of the sides of said first blank, other than the edges of the arcuate cut-outs, being secured to one another and forming a seam that extends along one side of the foot and ankle of the wearer, the two blanks as thus secured together forming a sock comprising a foot portion having substantially unobstructed, seamless plantar and dorsal surfaces, a fitted heel cup and at least a partial ankle encompassing portion.

2. A sock as set forth in claim 1 wherein the arcuate cut-out in one of the sides of the first blank is generally in the form of about three-fourths of an ellipse and enhances the fit of the heel cup with the heel of the wearer.

3. A sock as set forth in claim 2 wherein the cut-out defined in claim 2 and the seam that extends along one side of the foot and ankle of the wearer are located on the same side of the sock, the other side of the sock being substantially seamless.

4. A sock as set forth in claim 2 wherein the cut-out defined in claim 2 and the seam that extends along one side of the foot and ankle of the wearer are both located on the lateral side of the sock for engaging the lateral side of the foot of the wearer, the medial side of the sock being substantially seamless.

5. A sock as set forth in claim 3 wherein said blanks are secured together in such manner that a single seam runs from a toe section, along the one side of the sock, along part of the marginal edge of said heel cup and along said ankle portion of the sock.

6. A sock as set forth in claim 1 wherein said first blank is of a length and width to cover the foot and encompass the ankle and at least part of the calf of the wearer and the portions of said first blank to be occupied by the ankle and calf of the wearer are asymmetrical relative to a longitudinal center line of said foot section of said first blank and are secured together at their marginal edges so as to form a seam that extends along the anterior surface of the ankle and calf of the wearer.

7. A sock as set forth in claim 6 wherein said blanks are secured together in such manner that a single seam runs from a toe section, along the one side of the sock, along part of the marginal edge of said heel cup and along the anterior surface of the ankle and calf encompassing portions of the sock.

8. A sock as set forth in claim 1 wherein said blanks are secured together in such manner that a single seam runs from a toe section, along the one side of the sock, along part of the marginal edge of the heel cup and along the ankle portion of the sock.

9. A sock is set forth in claim 1, wherein said blanks are secured together by flatlock stitching.

10. A sock as set forth in claim 1 including an elliptical cut-out in the dorsal surface of said first blank in the region thereof to be occupied by the instep of the foot of the wearer, the lateral edges of the elliptical cut-out being secured together and fitting the sock to the instep of the wearer.

11. A sock as set forth in claim 10 wherein the lateral edges of the elliptical cut-out are secured together by top and bottom cover stitching that is stretchable for conforming the sock to the instep of the wearer.

12. A fleece sock comprising a first portion of fleece material of a length and width to cover the foot of the wearer, said first portion having a longitudinal center line at the end thereof to be occupied by the toes of the wearer and a rounded toe section on each side of the center line, said first portion at the other end thereof having a concave marginal edge, a second portion of fleece material of a length and width to encompass at least part of the ankle of the wearer, said second portion at one end thereof having a concave marginal edge juxtaposed to the concave marginal edge of said first portion, said first and second portions being secured together at their concave marginal edges and defining thereat a seam in the region of the sock to be occupied by the instep of the foot of the wearer, said first and second portions having common side edges each having an arcuate cut-out therein in the region to be occupied by the heel of the wearer, said first and second portions being folded along the center line of said first portion to align said toe sections and said cut-outs, and a third, generally circular portion of fleece material having opposed v-shaped dart cut-outs therein, the marginal edges of each dart cut-out being secured together and forming the third portion into a heel cup having arcuate marginal edges, the arcuate marginal edges of said heel cup being aligned with and secured to the marginal edges of the arcuate cut-outs in the sides of the first and second blanks, the marginal edges of the toe sections and the marginal edges of the sides of the first and second portions, other than the marginal edges of the arcuate cut-outs therein, being secured to one another and forming a seam that extends along one side of the foot and ankle of the wearer, the three portions as thus secured together forming a sock comprising a foot portion having substantially unobstructed plantar and dorsal surfaces, a fitted heel cup, a fitted instep and at least a partial ankle encompassing portion.

13. A sock as set forth in claim 12 wherein the concave marginal edges of the first and second portions are secured together by top and bottom cover stitching that is stretchable for conforming the sock to the instep of the wearer.

14. A method of making a fleece sock comprising the steps of forming a first blank of fleece material of a length and width to cover the foot and to compass at least a part of the ankle of the wearer, forming an arcuate cut-out in each side of the first blank in the region thereof to be occupied by the heel of the wearer, forming at the end of the first blank to be occupied by the toes of the wearer a rounded toe section, folding the first blank to align said toe sections and said cut-outs, forming a second generally circular blank of fleece material with opposed V-shaped dart cut-outs therein, securing the marginal edges of each dart cut-out together and forming the second blank into a heel cup having arcuate marginal edges, aligning the arcuate marginal edges of the heel cup with and securing the same to the marginal edges of the arcuate cut-outs in the sides of the first blank, and securing the marginal edges of the toe sections and the marginal edges of the sides of the first blank, other than the edges of the arcuate cut-outs therein, to one another and forming a seam that extends along one side of the sock, the two blanks as thus secured together forming a sock comprising a foot portion having unobstructed plantar and dorsal surfaces, a fitted heel cup and at least a partial ankle encompassing portion.

15. A method as set forth in claim 14 wherein the blanks are secured together by flatlock stitching.

16. A method as set forth in claim 15 further comprising the steps of stitching first portions of the marginal edge of the heel cup to the marginal edge of a first one of the arcuate cut-outs in the first blank, folding the first blank and stitching together the marginal edges of the toe sections and the marginal edges of the sides of the first blank in the region thereof to be occupied by the ball and arch of the foot of the wearer, stitching second portions of the marginal edge of the heel cup to the second one of the arcuate cut-outs in the first blank, and stitching together the marginal edges of the sides of the first blank in the region to be occupied by the ankle of the wearer.

17. A method as set forth in claim 16 wherein the stitching that stitches together the marginal edges of the toe sections, the sides of the first blank and the second portion of the edge of the heel cup to the second one of the arcuate cut-outs comprises one continuous seam.

18. A method as set forth in claim 14, including the steps of forming an elliptical cut-out in the region of the first blank to be occupied by the instep of the foot of the wearer and securing the lateral edges of the elliptical cut-out together to fit the sock to the instep.

19. A method as set forth in claim 18 including the step of forming the elliptical cut-out by making the first blank in two parts having juxtaposed ends each with an arcuate cut-out therein.

20. A method as set forth in claim 18 including the step of securing the lateral edges of the elliptical cut-out together by top and bottom cover stitching that it stretchable for conforming the sock to the instep of the wearer.

* * * * *